US009670599B2

(12) United States Patent
Haska et al.

(10) Patent No.: US 9,670,599 B2
(45) Date of Patent: Jun. 6, 2017

(54) SPINNING STATION OF AN AIR JET SPINNING MACHINE

(71) Applicant: Maschinenfabrik Rieter AG, Winterthur (CH)

(72) Inventors: Petr Haska, Ceska Trebova (CZ); Christian Griesshammer, Winterthur (CH)

(73) Assignee: Maschinenfabrik Rieter AG, Winterthur (CH)

( * ) Notice: Subject to any disclaimer, the term of this patent is extended or adjusted under 35 U.S.C. 154(b) by 69 days.

(21) Appl. No.: 14/426,570

(22) PCT Filed: Aug. 16, 2013

(86) PCT No.: PCT/IB2013/001799

§ 371 (c)(1),
(2) Date: Mar. 6, 2015

(87) PCT Pub. No.: WO2014/037775

PCT Pub. Date: Mar. 13, 2014

(65) Prior Publication Data

US 2015/0240393 A1 Aug. 27, 2015

(30) Foreign Application Priority Data

Sep. 7, 2012 (CH) ..... 1634/12

(51) Int. Cl.
*D01H 4/02* (2006.01)
*D01H 1/115* (2006.01)
(Continued)

(52) U.S. Cl.
CPC ..... *D01H 4/02* (2013.01); *D01H 1/115* (2013.01); *D01H 1/14* (2013.01); *D01H 7/92* (2013.01)

(58) Field of Classification Search
CPC ..... D01H 1/115; D01H 4/02; D01H 7/92
See application file for complete search history.

(56) References Cited

U.S. PATENT DOCUMENTS 5,159,806 A 11/1992 Mori et al.
5,295,349 A * 3/1994 Okamoto ..... D01H 4/02 57/328

(Continued)

FOREIGN PATENT DOCUMENTS

DE 43 03 515 A1 8/1994
DE 199 26 492 A1 4/2000

OTHER PUBLICATIONS

PCT Search Retort, Jan. 29, 2014.

*Primary Examiner* — Shaun R Hurley
(74) *Attorney, Agent, or Firm* — Dority & Manning, P.A.

(57) ABSTRACT

A spinning position on an air-jet spinning machine has a yarn-forming element extending at least partially into the turbulence chamber; and air jets directed into the turbulence chamber to impart to the fiber strand a twist in the area of an intake mouth of the yarn-forming element. A guide arrangement for guiding the fiber strand is situated in the area of the inlet port of the turbulence chamber and comprises at least two guide sections spaced a distance apart from one another, their mutual spacing decreasing in at least some sections in the direction of conveyance of the fiber strand. The guide arrangement also comprises at least one central guide element, which extends at least partially between the guide sections in a section running perpendicular to the longitudinal axis of the draw-off channel and produces a deflection of the fibers of the fiber strand perpendicular to the longitudinal axis of the draw-off channel.

13 Claims, 9 Drawing Sheets

(51) Int. Cl.
*D01H 7/92* (2006.01)
*D01H 1/14* (2006.01)

(56) References Cited

U.S. PATENT DOCUMENTS

| | | | | |
|---|---|---|---|---|
| 5,419,110 | A * | 5/1995 | Mikami | D01H 1/115 57/261 |
| 6,209,304 | B1 | 4/2001 | Feuerlohn et al. | |
| 2003/0131579 | A1* | 7/2003 | Feuerlohn | D01H 1/115 57/328 |
| 2005/0204720 | A1* | 9/2005 | Stahlecker | D01H 1/115 57/350 |

* cited by examiner

SPINNING STATION OF AN AIR JET SPINNING MACHINE

FIELD OF THE INVENTION

The present invention relates to a spinning position of an air-jet spinning machine that serves to produce a yarn from a fiber composite consisting of fibers, wherein the spinning position has a turbulence chamber with an inlet port for the fiber composite entering into the turbulence chamber in a conveyance direction during operation of the air-jet spinning machine, and also has a yarn-forming element extending at least partially into the turbulence chamber. The spinning position has air jets directed into the turbulence chamber and open into the turbulence chamber in the area of a wall surrounding the turbulence chamber and can be introduced into the turbulence chamber through the air in a predetermined direction of twist in order to impart a twist to the fiber composite in the aforementioned direction of twist in the area of an intake mouth of the yarn-forming element. The yarn-forming element has a draw-off channel through which the yarn can be removed from the turbulence chamber. A guide arrangement for guiding the fiber composite is situated in the area of the inlet port of the turbulence chamber, and wherein the guide arrangement comprises at least two guide sections spaced a distance apart from one another, wherein their mutual spacing decreases in at least some sections in the aforementioned conveyance direction.

BACKGROUND

Air-jet spinning machines with suitably equipped spinning positions are known in the prior art (see, for example, EP 0 990 719 B1, DE 40 36 119 C2) and are used to produce yarn from an elongated fiber strand. The outer fibers of the fiber strand are wound around the inner core fibers with the help of a turbulent air stream created by the air jets within the turbulence chamber in the area of the aforementioned intake mouth of the yarn-forming element and they ultimately form the wrap fibers that are important for the desired strength of the yarn. This yields a yarn with a true twist, which is ultimately discharged from the turbulence chamber through the draw-off channel and can be wound onto a bobbin, for example.

In general, in the sense of the present invention, the term "yarn" is thus understood to be a fiber strand, in which at least some of the fibers are wound around an inner core. This therefore includes a yarn in the traditional sense, which can be processed to form a fabric with the help of a weaving machine. The invention also relates to air-jet spinning machines with the help of which so-called roving (another term: sliver or slubbing) can be produced. This type of yarn is characterized in that, despite a certain strength, which is sufficient to convey the yarn to a downstream textile machine, it is still capable of being drawn. The roving can thus be drawn with the help of a drafting device, e.g., a drawing stand, on a textile machine that processes the roving, for example, a ring spinning machine, before being finally spun.

However, regardless of the strength of the yarn, it is always desirable for the twist created in the area of the yarn-forming element not to extend over the inlet port opposite the conveyance direction of the yarn and/or the fiber strand. In other words, it should be ensured that the fibers of the fiber strand retain their original alignment before contact with the turbulent air stream and receive the corresponding twist only inside the turbulence chamber. In other words, if the twist were to propagate in a direction opposite the direction of conveyance, then the reverse twist of the fiber strand associated with this would necessarily lead to a reduction in the desired wrap fibers and/or to a reduced drawability of the fiber strand in the area of a drafting device upstream from the turbulence chamber.

The twist retaining elements, which act on the fiber strand from the outside and are already known in the prior art, restrict the corresponding propagation of twist, but on the other hand, a reduction in the wrap fibers must usually be accepted (see in particular the EP 0 990 719 B1 cited above).

SUMMARY OF THE INVENTION

An object of the present invention is therefore to propose a spinning position for an air-jet spinning machine that will effectively counteract a reverse propagation of the twist of the fiber strand created in the area of the turbulence chamber in the direction opposite the direction of conveyance of same without causing an excessive reduction in the number of wrap fibers. Additional objects and advantages of the invention will be set forth in part in the following description, or may be obvious from the description, or may be learned through practice of the invention.

The objects are achieved by a spinning position having the features described herein.

According to the invention, the spinning position is characterized in that, in addition to the guide sections acting on the fiber strand from the outside, the guide arrangement comprises at least one central guide element, which extends at least partially between the guide sections in a section running perpendicular to the longitudinal axis of the draw-off channel. The central guide element is thus located in an area through which the fiber strand entering the turbulence chamber through the inlet port must pass. This leads to direct contact between the fiber strand and the central guide element, which ultimately causes a lateral deflection of the fibers of the fiber strand, i.e., directed at a right angle to a longitudinal axis of the draw-off channel. Whereas the outer guide sections now prevent reverse propagation of the twist created in the area of the yarn-forming element, the central guide element ensures that some of the fibers of the fiber strand are displaced outward and are thus captured especially effectively by the turbulent air current created by the air jets and can be wrapped around the central untwisted core of the fiber strand.

In summary, the guide arrangement according to the invention is thus made up of a central guide element which is situated in the path of conveyance of the fiber strand, and a plurality of guide sections, which are in turn also be placed in the area of the inlet port of the turbulence chamber and contact the fiber strand mainly from the outside as it passes through.

It is advantageous here if the central guide element runs on the longitudinal axis of the draw-off channel and/or a central axis of the inlet port of the turbulence chamber in at least some sections. Since the fiber strand is usually also guided so that its imaginary central axis runs on the longitudinal axis of the draw-off channel and/or the central axis of the inlet port, this ensures that the central guide element will be situated at least partially inside the fiber strand passing through. This in turn ensures that at least some of the fibers of the fiber strand are forced outward and can be captured by the air stream inside the turbulence chamber. In contrast with that, it should be ensured that the guide sections run outside of the aforementioned axes to permit guidance of the fiber strand from the outside and thus prevent reverse propagation of the twist.

Advantages are also achieved if the longitudinal axis of the draw-off channel runs parallel to and in particular colinear with the central axis of the inlet port. In other words, the inlet port and/or the wall surrounding the inlet port may run at least partially concentric to the intake mouth of the draw-off channel. The fiber strand is not deflected as a whole in this case. Instead, at least the end of the central guide element facing the draw-off channel lies on a line corresponding to the imaginary longitudinal axis of the incoming fiber strand. The fiber strand is thus guided basically in a straight line, starting from the inlet port of the turbulence chamber up to the area of the draw-off channel (even if the deflection of the fibers described above, in which the fibers are forced outward, occurs in the area of the central guide element, distributed preferably uniformly around the circumference of the fiber strand due to the presence of the central guide element and starting therefrom).

It is especially advantageous if the guide sections are formed by guide mandrels or guide plates, which extend from a wall surrounding the inlet port of the turbulence chamber in the direction of the intake mouth of the yarn-forming element. In the case of mandrels, it has proven successful to provide them with a pointed end, but the plates may be rounded toward one or more sides in order to prevent damage to the fibers passing by. The plates also preferably extend radially toward the inside and, as in the case of the guide mandrels, may be attached to the wall of the spinning position or may be designed in one piece therewith. In any case, it has proven successful to place the guide sections at equal intervals from one another.

It is advantageous if one end of the central guide element, the end sent to an outlet port of the draw-off channel, is placed between the intake mouth of the yarn-forming element and the inlet port of the turbulence chamber. In this case, that end is located in the area in which the fiber strand enters the area of the turbulent air flow. This ensures that the fibers of the fiber strand are forced outward by the guide element running in the interior of same and are thus wrapped as wrap fibers around the remaining fibers to a greater extent. In this case, the guide sections may either also extend into the aforementioned area of the spinning position but it is also conceivable that these guide sections are placed completely in the inlet port of the turbulence chamber and thus do not directly enter the flow area of the turbulent air stream.

It is also advantageous if the central guide element extends further in the direction of an outlet port of the draw-off channel than the guide sections. This ensures that the air flow, which surrounds the fiber strand in the area of the end of the central guide element pointing in the direction of the outlet port, does not come in contact with the outer guide sections of the guide arrangement according to the invention. The distance between the central guide element and the neighboring guide sections here may amount to between one millimeter and a few millimeters.

In addition, it is advantageous if at least some of the guide sections and/or the central guide element extend(s) into the draw-off channel. Such an arrangement ensures that the desired effect of the respective component is maintained until the fibers are situated inside the draw-off channel and they are no longer exposed to the turbulent air flow or only to a minor extent. The elements protruding into the draw-off channel should have in this region a cross-sectional area that is smaller than one-half (preferably one-third) of the cross-sectional area of the intake mouth of the draw-off channel in order to prevent blockage of the draw-off channel.

It is also advantageous if the minimum distance between two guide sections is greater than the minimum distance between one guide section and one end of the central guide element facing an outlet port of the draw-off channel. In other words, it may be advantageous if the end sections of the guide sections facing the outlet port of the draw-off channel are placed relatively close to the corresponding end section of the central guide element. In this location, the fiber strand is inflated from the inside by the central guide element (the individual fibers are forced outward in the radial direction—based on the longitudinal axis of the draw-off channel), so that at least the fiber ends of the fiber strand on the outside come in contact with the guide sections. This is an especially effective way to prevent a reverse twist of the fiber strand.

There are also advantages when the guide sections each have one end facing an outlet port of the draw-off channel and one end facing the outlet port, such that one end of the central guide element facing the outlet port of the draw-off channel is placed in a section running parallel to the longitudinal axis of the draw-off channel between the respective ends of the guide sections. In other words, it is preferable that the fiber strand must pass through an area in which it is simultaneously in contact with the guide sections acting on it from the outside and the central guide element running mostly in the interior. A reverse propagation of the yarn twist can be prevented especially effectively in this way with an adequate number of wrap fibers.

It is particularly advantageous if both the central guide element and the guide sections have one end facing an outlet port of the draw-off channel, such that the aforementioned ends of the guide sections are placed concentrically around the aforementioned end of the central guide element in a section running perpendicular to the longitudinal axis of the draw-off channel. Although the central guide element should thus be placed centrally in the aforementioned section, it is advantageous to place the guide sections on a circular path around the centrally situated central guide element. The central guide element (and/or its central axis in the area of the end section facing the outlet port of the draw-off channel) in this case forms, to a certain extent, the midpoint of a circle on which the corresponding end sections of the guide sections are situated.

It is also advantageous if the minimal distance of two guide sections is smaller than the diameter of the draw-off channel in the area of the intake mouth of the yarn-forming element. Twisting of the fiber strand in the area of the guide arrangement is thereby prevented especially effectively, in particular when the distance of the guide sections is smaller than the diameter of the yarn produced.

Advantages are also achieved when at least one guide section forms an angle $\alpha$ with the longitudinal axis of the draw-off channel, the size of this angle assuming a value between 10° and 50°, preferably a value between 20° and 40°, especially preferably a value between 25° and 35°. The guide sections and/or the mandrels forming the guide sections should thus form an acute angle with the longitudinal axis of the draw-off channel, as seen in the direction of conveyance of the fiber strand, in order to allow the fiber strand to slide along the guide sections on the fiber strand without mutual entanglement.

It is also advantageous if, in the absence of the fiber strand, at least two guide sections come in contact mutually and/or at least one guide section comes in contact with the central guide element. The interspace through which the fiber strand must pass is minimal in this case. Regardless of the fiber strand used and/or its cross-sectional area, this ensures that direct contact with the guide sections and/or the central guide section prevails in passing through same. However, in this case the guide sections should be designed to be flexible in order to be able to rule out splitting of the fiber strand in the longitudinal direction.

Finally, it may be advantageous if the guide sections and/or the central guide element are part of an insert having a stationary or movable mount with respect to the turbulence chamber. In this case, the guide sections and the central guide element are jointly interchangeable with the insert, so that the spinning position can be rapidly adapted to different types of fiber strands and/or dimensions. The insert is preferably designed in the form of a sleeve. The guide sections and/or the central guide element may also be part of the insert or connected to it.

BRIEF DESCRIPTION OF THE DRAWINGS

Additional advantages of the invention are described in the following exemplary embodiments, in which.

DETAILED DESCRIPTION

Figure 1:
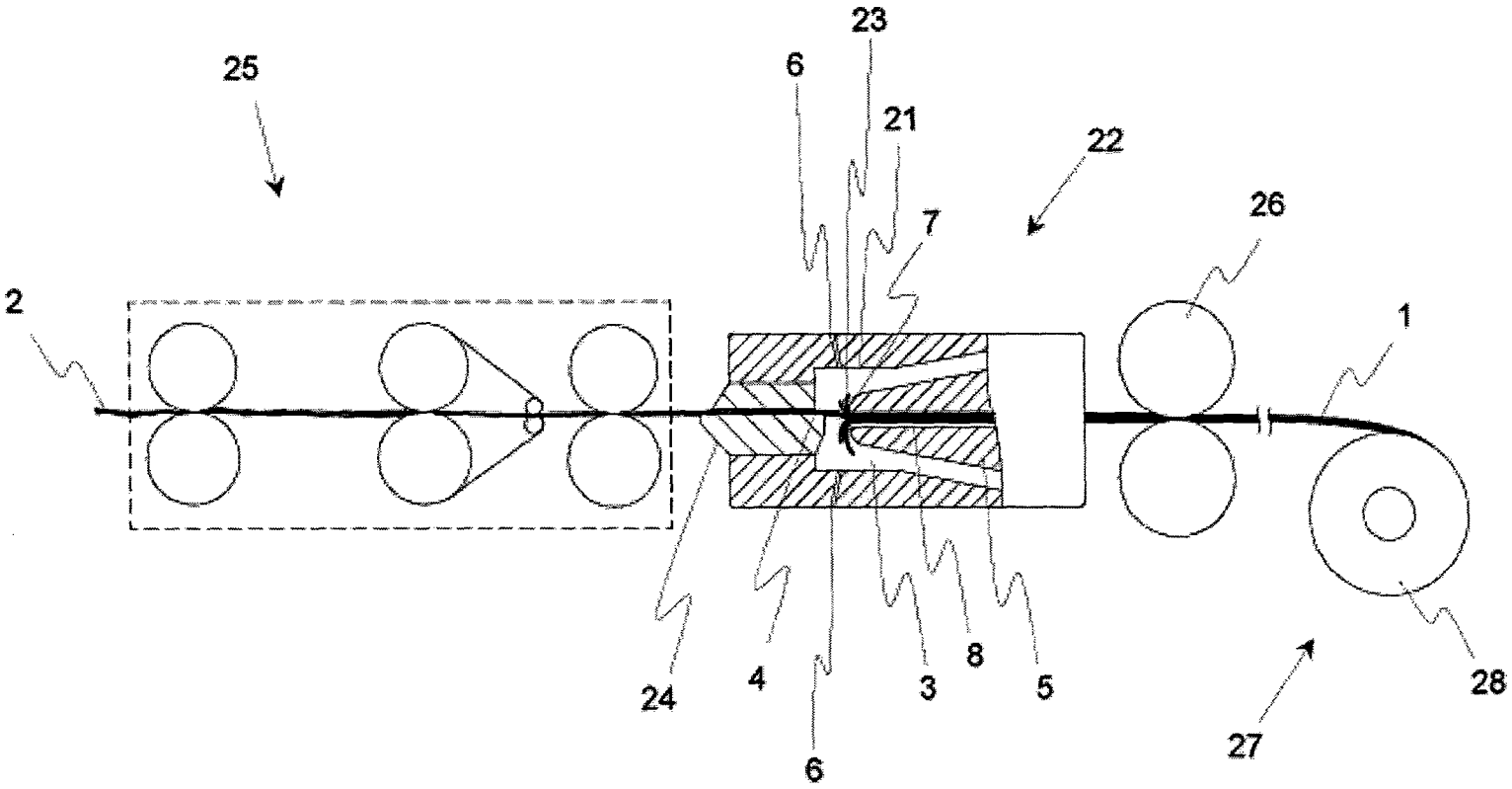
FIG. 1 shows a detail of a partially cutaway spinning position on an air-jet spinning machine.

Reference will now be made to embodiments of the invention, one or more examples of which are shown in the drawings. Each embodiment is provided by way of explanation of the invention, and not as a limitation of the invention. For example features illustrated or described as part of one embodiment can be combined with another embodiment to yield still another embodiment. It is intended that the present invention include these and other modifications and variations to the embodiments described herein.

FIG. 1 shows a schematic view of a detail of an air-jet spinning machine. The air-jet spinning machine may comprise, as needed, a drawing frame 25, which is supplied with a fiber strand 2, for example, in the form of a doubled drawing frame sliver. Furthermore, the air-jet spinning machine shown here has a plurality of spinning positions 22 situated next to one another, each having an interior turbulence chamber 3, in which the fiber strand 2 and/or at least some of the fibers of the fiber strand 2 are provided with a twist (the precise mechanism of action of the spinning position 22 is described in greater detail below).

In addition, the air-jet spinning machine may comprise a draw-off roll pair 26 and a winding device 27 (also shown schematically) downstream from the draw-off roll pair 26 with a bobbin 28 for winding the yarn 1 having the desired twist on exiting the spinning position 22. The device according to the invention need not necessarily have a drawing frame 25, as illustrated in FIG. 1. The draw-off roll pair 26 is also not absolutely necessary.

The spinning machine shown here operates according to an air-jet spinning process. To form the yarn 1, the fiber strand 2 is guided over a fiber guide element 24, which is equipped with an inlet port into the turbulence chamber 3 of the spinning position 22 (see also FIG. 2), where a type of twist is imparted to the fiber strand, i.e., at least some of the free fiber ends 23 of the fiber strand are caught up by an air stream generated by air jets 6 situated accordingly in a wall 21 surrounding the turbulence chamber 3. Some of the fibers are extracted at least a short distance from the fiber strand 2 in this process and are wrapped around the tip of a yarn-forming element 5 protruding into the turbulence chamber 3. Due to the fact that the fiber strand 2 is pulled out of the turbulence chamber 3 through an intake mouth 7 of the yarn-forming element 5 over a draw-off channel 8 situated inside the yarn-forming element 5, ultimately the free fiber ends 23 (see FIG. 1) are also drawn in the direction of the intake mouth 7 and are wrapped as so-called wrap fibers around the core fibers running centrally—resulting in a yarn 1 having the desired twist.

It should be pointed out here in general that the yarn 1 thus produced may fundamentally be any type of fiber strand, which is characterized in that an exterior portion of the fibers (so-called wrap fibers) is wrapped around an interior portion of the fibers, preferably without a twist, to impart the desired strength to the yarn 1. The invention thus also includes an air-jet spinning machine, which can produce a so-called roving. Roving is yarn 1 having a relatively small number of wrap fibers, or a yarn 1 in which the wrap fibers are wrapped relatively loosely around the inner core, so that the yarn 1 remains drawable. This is crucial if the yarn 1 thus produced should or must be drawn again on a downstream textile machine (a ring spinning machine, for example) with the help of a drawing frame 25 in order to be able to process it further accordingly.

With regard to the air jets 6, it should be pointed out here as a precaution that these air jets should usually be oriented so that all of the streams of air exiting the air jets are aimed in the same direction in order to jointly produce a unidirectional stream of air with one direction of twist. The individual air jets 6 here are preferably arranged in rotational symmetry to one another.

Figure 2:
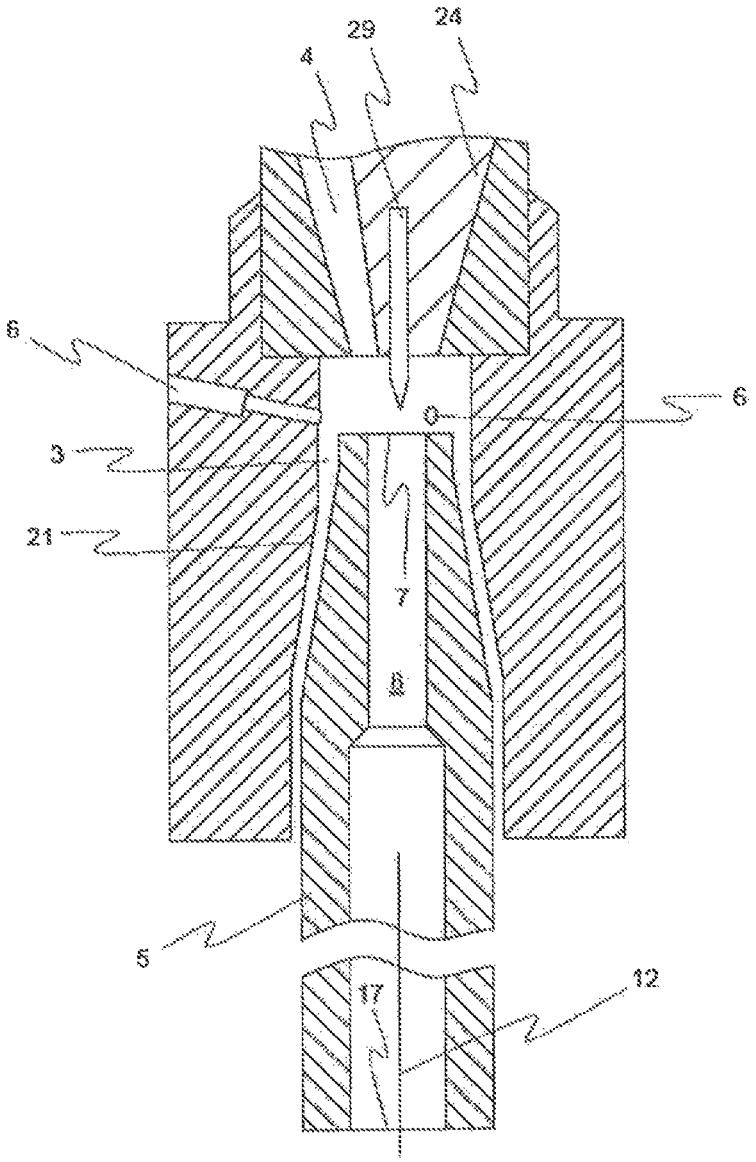
Fig. 2 Prior Art
FIG. 2 shows a sectional diagram of a detail of a known spinning position on an air-jet spinning machine.

The spinning positions 22 known in the prior art preferably have a twist retaining element 29, which is inserted into the fiber guide element 24, for example. As shown in FIG. 2, this may be designed as a pin, around which the fibers are partially wrapped, and it prevents a twist in the fiber strand 2 from being propagated in a direction opposite the direction of conveyance of the fiber strand 2 and thus in the direction of the inlet port 4 of the fiber guide element 24.

However, since the pin shown here or other comparable, centrally arranged elements can always act only from the inside on the fiber strand 2 surrounding the twist retaining element 29, the effect of the same is limited. Furthermore, there is a mechanical load on the fibers, which undergo a lateral deflection in the area of the twist retaining element 29 that is not negligible.

In contrast with that, the spinning position 22 according to the invention has only one novel guide arrangement 9, which causes a reverse propagation of the twist in the direction opposite the direction of conveyance of the fiber strand 2, without thereby reducing the number of desired wrap fibers excessively.

Figure 3A:
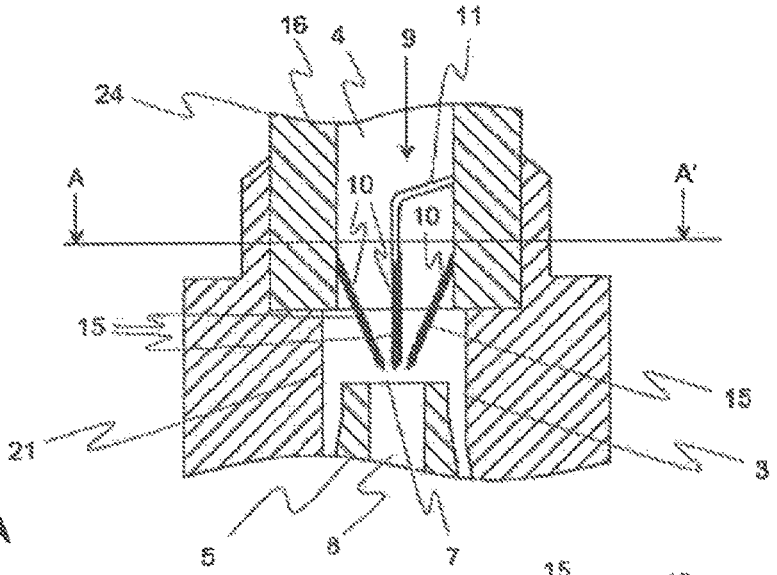
FIGS. 3A and 3B show a detail of a sectional diagram of an air-jet spinning machine according to the invention (FIG. 3A) and a sectional diagram along the sectional face A-A' (FIG. 3B)
Figure 3B:
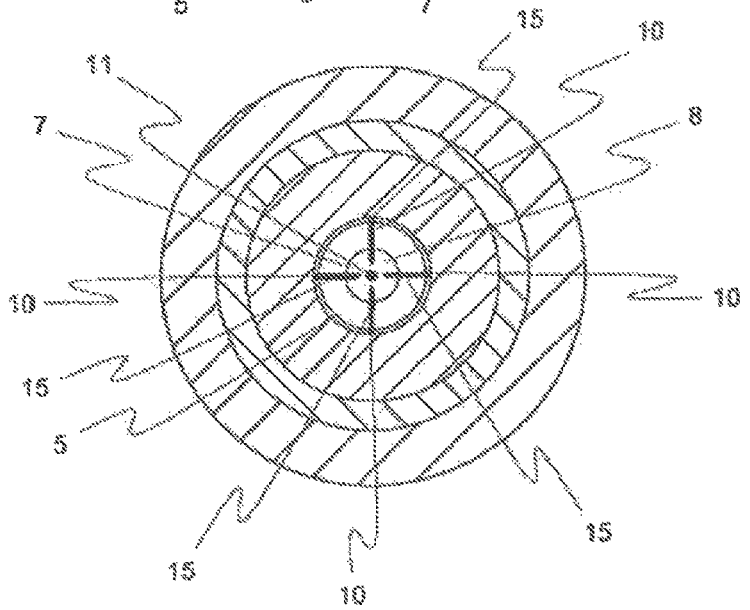
Figure 4:
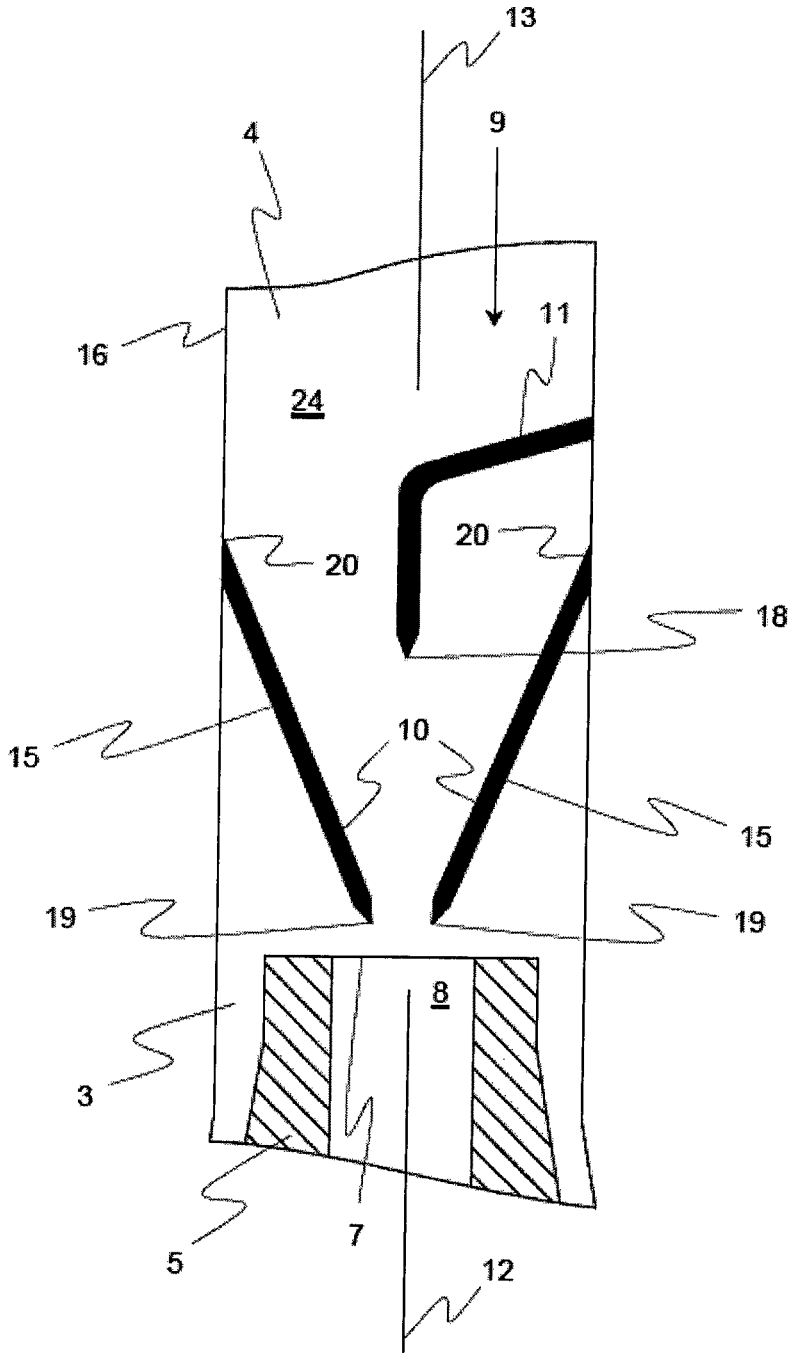
FIG. 4 shows the area of the inlet port of the turbulence chamber of a spinning position according to the invention.

As shown in FIGS. 3A and 3B, the guide arrangement 9 now has at least two guide sections 10 spaced a distance apart from one another (there are four in FIG. 3), the mutual spacing of which decreases in the direction of conveyance of the fiber strand 2 (in at least some sections). In other words, the spinning position 22 has a plurality of elements acting on the fiber strand 2 from the outside, these elements converging toward one another in the direction of conveyance of the fiber strand 2. The fiber strand 2 therefore necessarily comes in contact with the guide sections 10 and is captured by them from the outside, so to speak, thereby preventing a twisting of same in the area of the guide sections 10.

However, to ensure that partial separation of the external fiber ends 23 is possible despite the fiber guidance acting from the outside in order to form the desired wrap fibers, it is also provided that the guide arrangement 9 additionally comprises at least one central guide element 11, which extends at least partially between the guide sections 10 in a section running perpendicular to the longitudinal axis 12 of the draw-off channel 8 (see bottom diagram in FIG. 3). Whereas the outer guide sections 10 cause guidance of the fiber strand 2 "from the outside," the central guide element 11 is situated "in the interior" of the fiber strand 2 to a certain extent during yarn production and thus causes the fiber strand to be forced open. In other words, the fibers are deflected outward due to the central guide element 11 or, to put it in geometric terms, the fibers are deflected at a right angle to the longitudinal axis 12 of the draw-off channel 8. The free fiber ends 23 are also forced outward to a greater extent in this way, which ensures that, despite the outer guide sections 10, the fibers enter the area of the air stream created by the air jets 6 and can be wrapped around the fiber core.

Whereas FIG. 3 serves mainly to illustrate the invention in principle, FIGS. 4 through 9 show different examples of the alignment, design and mutual arrangement of the guide sections 10 and the central guide element 11.

Whereas the guide sections 10, which are preferably situated concentrically around the central guide element 11 in the sectional diagram shown at the bottom of FIG. 3, and also the central guide element 11 may also be positioned outside of the yarn-forming element 5 (FIG. 4), it is also conceivable that either the guide sections 10 (FIG. 5) or the central guide element 11 (FIG. 6) extends into the draw-off channel 8 of the yarn-forming element 5.

Figure 7:
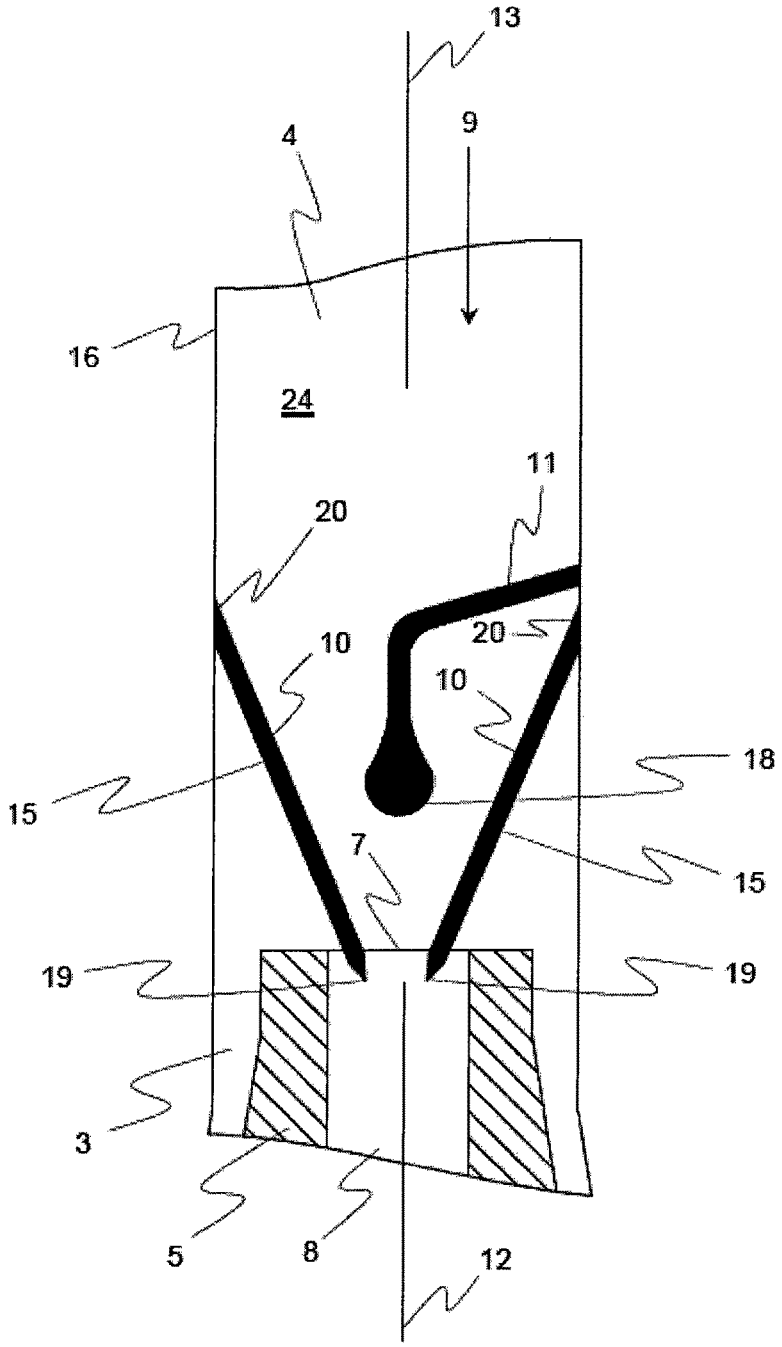
Figure 8:
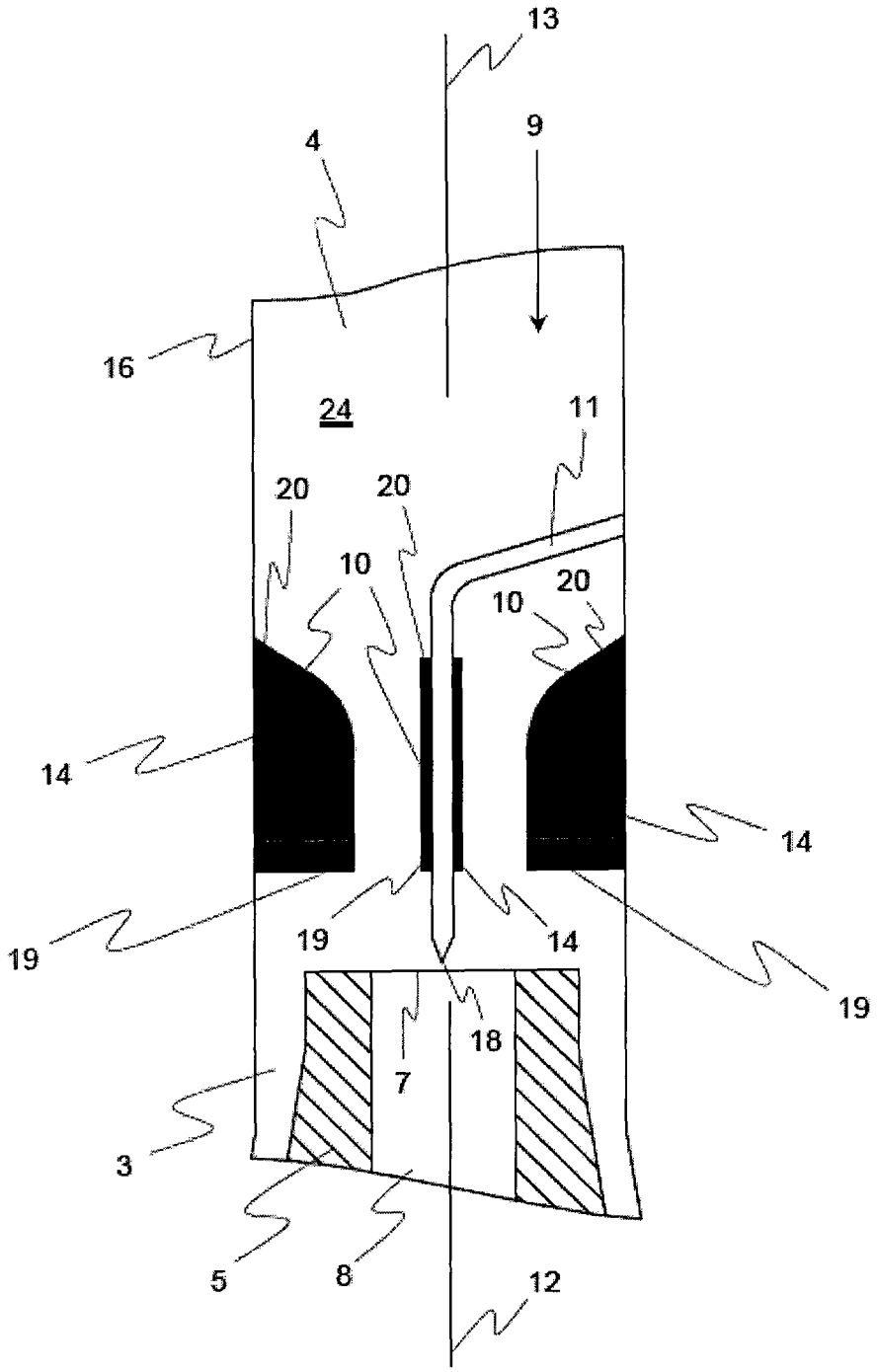

Furthermore, the central guide element 11 need not necessarily be in the form of a guide mandrel 15 that is provided with a tip, as shown in FIGS. 3A and 3B, for example. Other embodiments are also conceivable instead. Thus the central guide element 11 may have a droplet-shaped or spherical end, for example, as shown in FIG. 7. This would result in a particularly strong lateral deflection of the fibers and thus an increased number of wrap fibers.

The shape and orientation of the guide sections 10 are not limited in principle to one specific embodiment. Thus, for example, instead of the rod-shaped guide sections 10 shown in FIG. 4, it would be conceivable to also use the guide plates 14 indicated in FIG. 8, which also prevent a reverse twist of the fiber strand 2 in the direction opposite the direction of conveyance.

Figure 5:
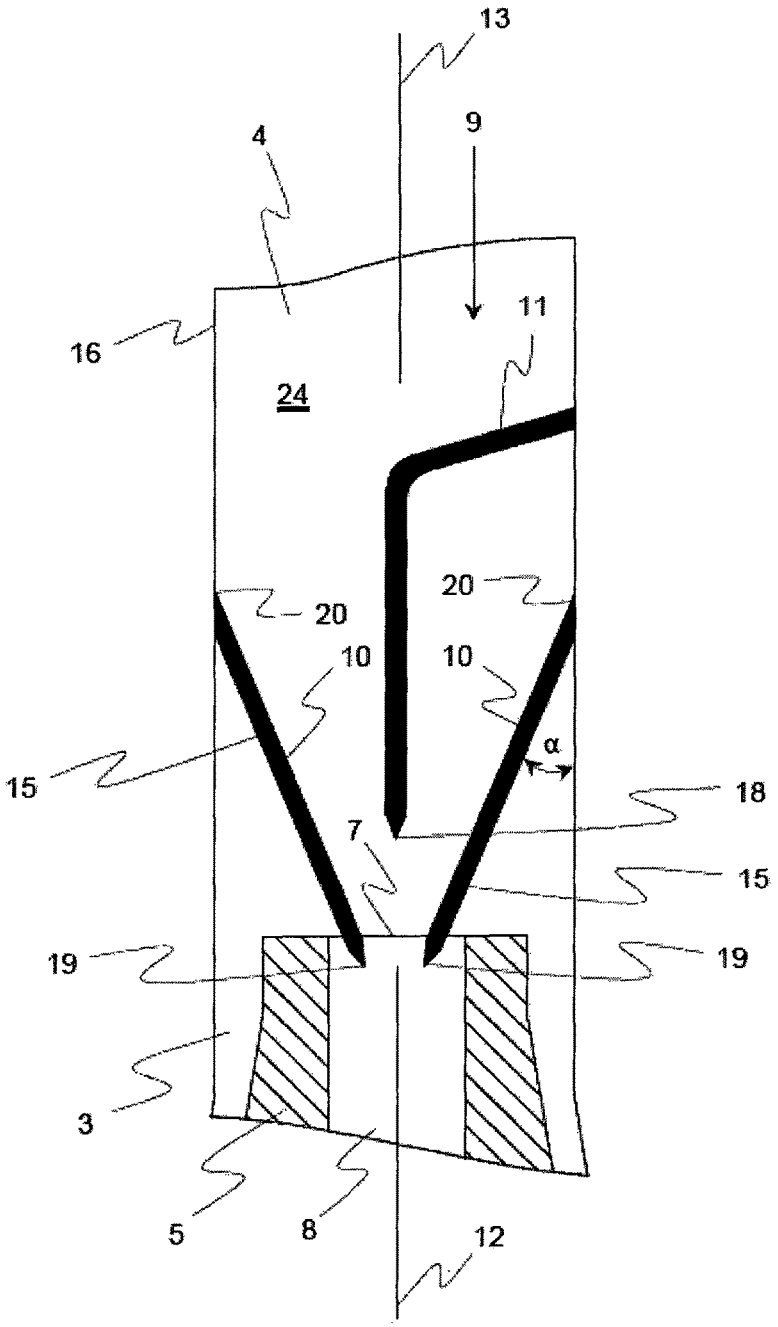
FIGS. 5 to 9 show alternative embodiments of the area shown in FIG. 4.

With regard to the guide mandrels 15 shown here, it should also be pointed out that these should preferably form an angle $\alpha$ with the longitudinal axis 12 of the draw-off channel 8 (for reasons of simplicity, this angle is identifiable only in FIG. 5, where the wall runs parallel to the longitudinal axis 12 around the inlet port 4). The size of this angle amounts to a value between 10° and 50°, preferably a value between 20° and 40°, especially preferably a value between 25° and 35°.

It is also advantageous in general if the end 18 of the central guide element 11 facing the outlet port 17 of the draw-off channel 8 is situated in a section running parallel to the longitudinal axis 12 of the draw-off channel 8 (corresponding to the diagrams according to FIGS. 4 through 9) between the ends 19 of the guide sections 10 facing the outlet port 17 of the draw-off channel 8 and the ends 20 of same facing away from the outlet port 17 of the draw-off channel 8. This ensures that the fiber strand 2 is in contact simultaneously with the outer guide sections 10 and the central guide element 11, at least in a partial section of the guide arrangement 9.

It should also be pointed out here that the central guide element 11 (and/or its end 18 facing the outlet port 17 of the draw-off channel 8) should run on the longitudinal axis 12 of the draw-off channel 8, which may in turn be situated to be colinear with the central axis 13 of the inlet port 4. The fiber strand 2 thus encounters the central guide element 11 centrally and is deflected laterally accordingly because it must pass by the central guide element 11.

Figure 6:
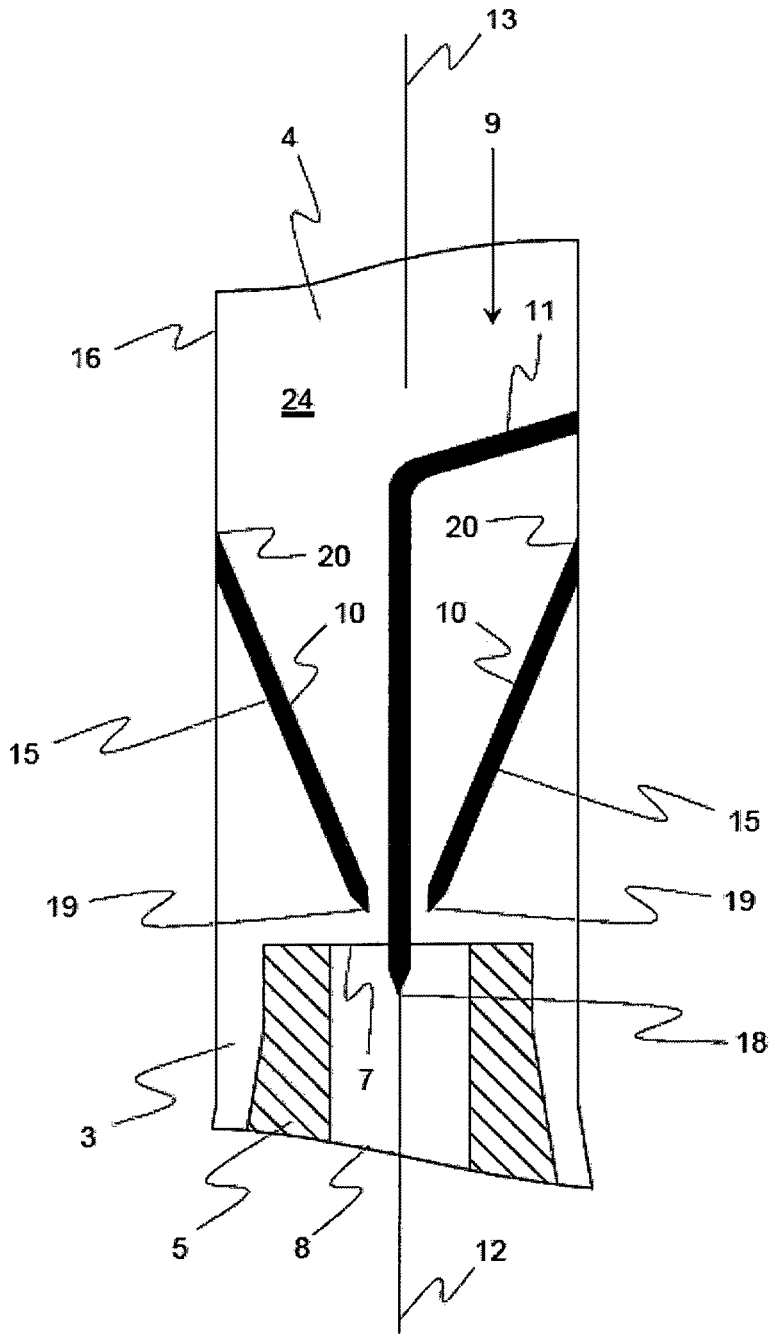
Figure 9:
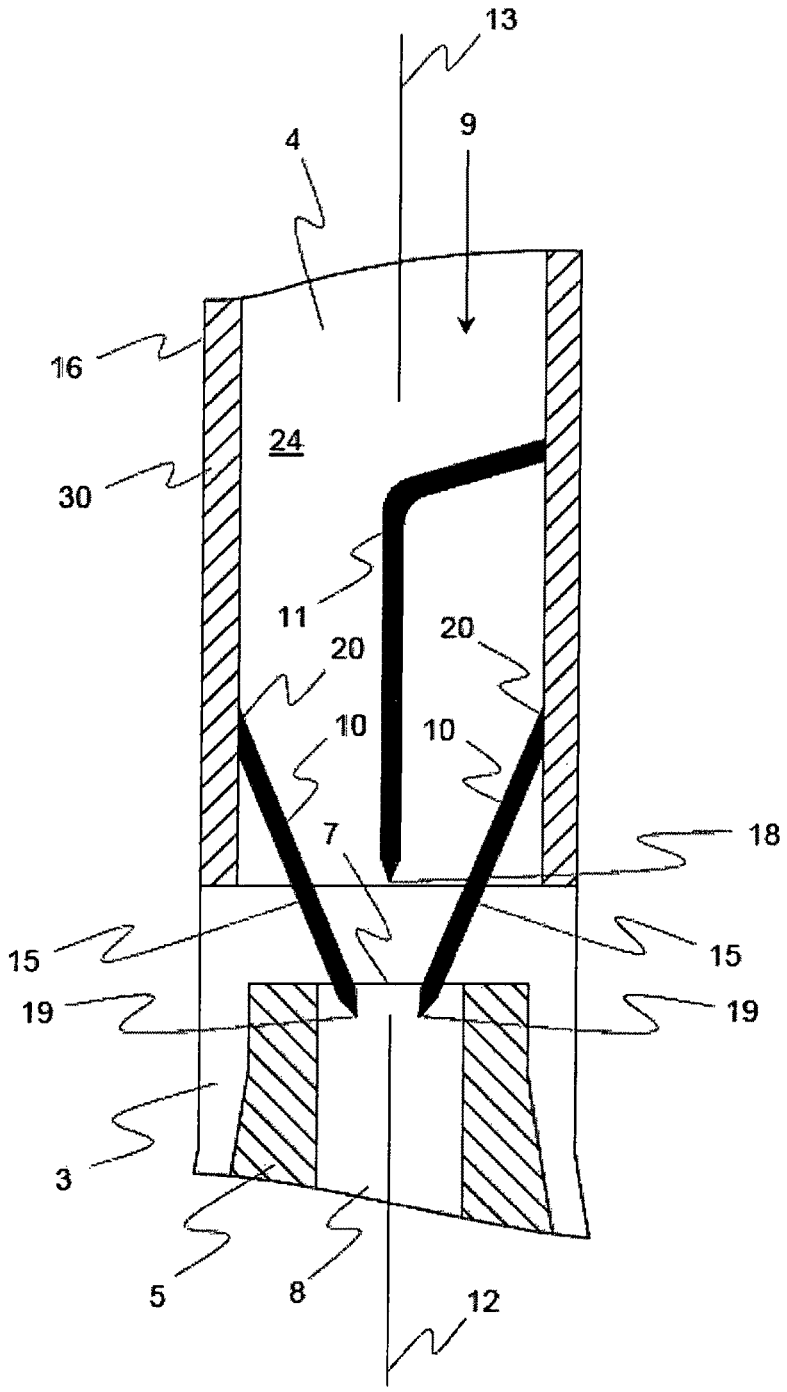

Finally, as shown by a comparison of FIG. 9 with FIG. 6, for example, the guide sections 10 and/or the central guide element 11 may be directed away from the wall 16 surrounding the inlet port 4 in the direction of the yarn-forming element 5, for example. Alternatively, however, it is also possible to affix the guide sections 10 and/or the central guide element 11 in another location. For example, an insert 30 (having a sleeve-shaped design, for example), as indicated in FIG. 9 might be used, surrounding the guide sections 10 and/or the central guide element 11 or with the aforementioned components being attached to it.

The present invention is not limited to the exemplary embodiment depicted and described here. Modifications within the context of the patent claims are also possible, such as a combination of the features, even if they are illustrated and described in different exemplary embodiments.

The invention claimed is:

1. A spinning position on an air-jet spinning machine, which serves to produce a yarn from a fiber strand consisting of fibers, comprising:

a turbulence chamber with an inlet port for the fiber strand entering the turbulence chamber in a direction of conveyance during operation of the air-jet spinning machine;

a yarn-forming element extending into the turbulence chamber, the yarn-forming element having an intake mouth and a draw-off channel through which yarn is drawn off out of the turbulence chamber;

air jets directed into the turbulence chamber, the air jets opening into the turbulence chamber in a wall surrounding the turbulence chamber, such that air can be introduced through these jets into the turbulence chamber in a predefined direction to impart to the fiber strand a twist in the area of an intake mouth of the yarn-forming element;

a guide arrangement situated in the area of the inlet port of the turbulence chamber, the guide arrangement further comprising at least two guide sections spaced a distance apart from one another that decreases in at least some sections in the direction of conveyance of the fiber strand;

the guide arrangement further comprising at least one central guide element that extends at least partially between the guide sections viewed in a section running perpendicular to a longitudinal axis of the draw-off channel and producing a deflection of the fibers of the fiber strand perpendicular to the longitudinal axis of the draw-off channel; and wherein the guide sections are formed by one of mandrels or guide plates that extend from a wall surrounding the inlet port of the turbulence chamber towards the inlet mouth of the yarn-forming element.

2. The spinning position according to claim 1, wherein the central guide element runs along one of the longitudinal axis of the draw-off channel or a central longitudinal axis of the inlet port of the turbulence chamber.

3. The spinning position according to claim 2, wherein the longitudinal axis of the draw-off channel is collinear with the central longitudinal axis of the inlet port of the turbulence chamber.

4. The spinning position according to claim 1, wherein an end of the central guide element oriented towards the outlet port of the draw-off channel is positioned between the intake mouth of the yarn-forming element and the inlet port of the turbulence chamber.

5. The spinning position according to claim 1, wherein the central guide element extends further in a direction towards the outlet port of the draw-off channel than the guide sections.

6. The spinning position according to claim 1, wherein one or both of the guide sections and the central guide element extend into the draw-off channel.

7. The spinning position according to claim 1, wherein a minimal distance between the guide sections is greater than a minimal distance between the guide sections and the central guide element facing the outlet port of the draw-off channel.

8. The spinning position according to claim 1, wherein the guide sections each have a first end towards the outlet port of the draw-off channel and an opposite end away from the outlet port of the draw-off channel, the central guide element having a first end towards the outlet port of the draw-off channel with a section running parallel to a longitudinal axis of the draw-off channel between the first ends of the guide sections.

9. The spinning position according to claim 1, wherein the central guide element has a first end towards the outlet port of the draw-off channel, the guide sections each have a first end towards the outlet port of the draw-off channel, wherein the first ends of the guide sections are arranged concentrically around the first end of the central guide element view in a section that is perpendicular to a longitudinal axis of the draw-off channel.

10. A spinning position on an air-jet spinning machine, which serves to produce a yarn from a fiber strand consisting of fibers, comprising:

a turbulence chamber with an inlet port for the fiber strand entering the turbulence chamber in a direction of conveyance during operation of the air-jet spinning machine;

a yarn-forming element extending into the turbulence chamber, the yarn-forming element having an intake mouth and a draw-off channel through which yarn is drawn off out of the turbulence chamber;

air jets directed into the turbulence chamber, the air jets opening into the turbulence chamber in a wall surrounding the turbulence chamber, such that air can be introduced through these jets into the turbulence chamber in a predefined direction to impart to the fiber strand a twist in the area of an intake mouth of the yarn-forming element;

a guide arrangement situated in the area of the inlet port of the turbulence chamber, the guide arrangement further comprising at least two guide sections spaced a distance apart from one another that decreases in at least some sections in the direction of conveyance of the fiber strand;

the guide arrangement further comprising at least one central guide element that extends at least partially between the guide sections viewed in a section running perpendicular to a longitudinal axis of the draw-off channel and producing a deflection of the fibers of the fiber strand perpendicular to the longitudinal axis of the draw-off channel; and wherein a minimal distance between the guide sections is less than a diameter of the draw-off channel in an area of the intake mouth of the yarn-forming element.

11. The spinning position according to claim 1, wherein the guide sections define an angle relative to a longitudinal axis of the draw-off channel between 10 degrees and 50 degrees.

12. A spinning position on an air-jet spinning machine, which serves to produce a yarn from a fiber strand consisting of fibers, comprising:

a turbulence chamber with an inlet port for the fiber strand entering the turbulence chamber in a direction of conveyance during operation of the air-jet spinning machine;

a yarn-forming element extending into the turbulence chamber, the yarn-forming element having an intake mouth and a draw-off channel through which yarn is drawn off out of the turbulence chamber;

air jets directed into the turbulence chamber, the air jets opening into the turbulence chamber in a wall surrounding the turbulence chamber, such that air can be introduced through these jets into the turbulence chamber in a predefined direction to impart to the fiber strand a twist in the area of an intake mouth of the yarn-forming element;

a guide arrangement situated in the area of the inlet port of the turbulence chamber, the guide arrangement further comprising at least two guide sections spaced a distance apart from one another that decreases in at least some sections in the direction of conveyance of the fiber strand;

the guide arrangement further comprising at least one central guide element that extends at least partially between the guide sections viewed in a section running perpendicular to a longitudinal axis of the draw-off channel and producing a deflection of the fibers of the fiber strand perpendicular to the longitudinal axis of the draw-off channel; and wherein in the absence of a fiber strand, the guide sections touch each other or the central guide element.

13. The spinning position according to claim 1, wherein the guide sections and the central guide element are formed in an insert that is supported relative to the turbulence chamber.

* * * * *